United States Patent [19]

Goulet et al.

[11] 4,076,248

[45] Feb. 28, 1978

[54] MARBLE GAME WITH RETRACTABLE PLAYING SURFACE

[76] Inventors: Guy Goulet; John Goulet, both of 400 Kings Point Drive, N. Miami Beach, Fla. 33160

[21] Appl. No.: 684,284

[22] Filed: May 7, 1976

[51] Int. Cl.[2] ..... A63F 3/00; A63F 7/00

[52] U.S. Cl. ..... 273/123 R; 273/127 R

[58] Field of Search ..... 273/123 R, 123 A, 136 GA, 273/136 GB, 136 K, 127 R, 127 B

[56] References Cited

U.S. PATENT DOCUMENTS

| | | | |
|---|---|---|---|
| 830,180 | /1906 | Schultz | 273/123 R |
| 3,065,968 | /1962 | Gelencser | 273/127 R |
| 3,141,673 | /1964 | Scott | 273/123 R |

FOREIGN PATENT DOCUMENTS

| | | | |
|---|---|---|---|
| 329,321 | 1903 | France | 273/136 GA |

*Primary Examiner*—Richard C. Pinkham
*Assistant Examiner*—Lawrence E. Anderson
*Attorney, Agent, or Firm*—Robert D. Farkas

[57] ABSTRACT

A game apparatus for use with marbles or the like comprising a unitary housing having substantially parallel upper and lower surfaces, the housing having a plurality of collecting chambers therein, the collecting chambers adapted to cooperate with a plurality of apertures disposed in the first lateral surface of the housing, the apertures permitting the passage of marbles or the like into the collecting chamber; an elongated roller element rotatably secured within an elongated chamber disposed within the housing; apparatus for rotating the elongated roller element; and a substantially rectangular flexible sheet element affixed on a free edge thereof to the roller element, the sheet element adapted to pass through an opening in the housing and extend outwardly toward the apertures and thereinfront thereby serving as a playing surface.

3 Claims, 5 Drawing Figures

MARBLE GAME WITH RETRACTABLE PLAYING SURFACE

BACKGROUND OF THE INVENTION

1. Field of the Invention

The present invention relates to game apparatuses, and more particularly, to game apparatus played with conventional marbles or the like.

2. Description of the Prior Art

Numerous games exist in the prior art where marbles or the like are propelled by the player for various purposes including the hitting of targets or the projection of marbles into various holes placed in a playing surface. Limited skill is needed in the playing of these games as the size of the integral playing surface is predetermined at the time of manufacture. Continued use causes the players to become very familiar with specific methods of success and mastery of these methods may lead to player boredom.

The present invention provides a game apparatus for use with marbles or the like which may be placed at various distances and angles from the player employing various surfaces such as grass lawns, concrete, or carpeting as the playing surface thereby providing a virtually endless combination of challenges to a variety of the players' skills.

SUMMARY OF THE INVENTION

Therefore, it is a primary object of the present invention to provide a game apparatus for use with marbles or the like which may be placed on various surfaces which are utilized as playing surfaces.

A further object is to provide a game apparatus with provision for the storage therein of all components needed for play.

A still further object is to provide a game apparatus which is simple in design and very durable.

These objects, as well as further objects and advantages, of the present invention will become readily apparent after reading the description of a non-limiting illustrative embodiment and the accompanying drawing.

The present invention provides a unitary housing which has substantially parallel upper and lower surfaces. The housing has a plurality of apertures in a lateral surface thereof. Each of the apertures are adapted to permit the passage of marbles or the like into a plurality of corresponding collecting chambers within the housing. The housing also includes an elongated chamber therein which is adjacent to a second lateral surface that is opposite the first lateral surface. The lower surface of the housing has an elongated opening therein extending into the elongated chamber. An elongated roller element is disposed within the elongated chamber and is rotatably secured by rotatable securing means. Means for rotating the elongated roller element are provided and are accessable from outside the housing. A substantially rectangular flexible sheet element is affixed on a free edge thereof to the elongated roller element. The sheet element is adapted to pass through the elongated opening and extend outwardly toward the aperture in the first lateral surface and thereinfront thereby serving as a primary playing surface. The surface the game is rested upon serves as a secondary playing surface. When the game apparatus is not in use the flexible sheet element is wound around the elongated roller element for storage. An upper hollow housing having a plurality of sub-chambers therein for storage of marbles or the like is adapted to be affixed over the upper surface of the unitary housing and a cover element is provided and is adapted to be affixed to the lower surface of the unitary housing, both thereby permitting the game apparatus and playing components to be self contained.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
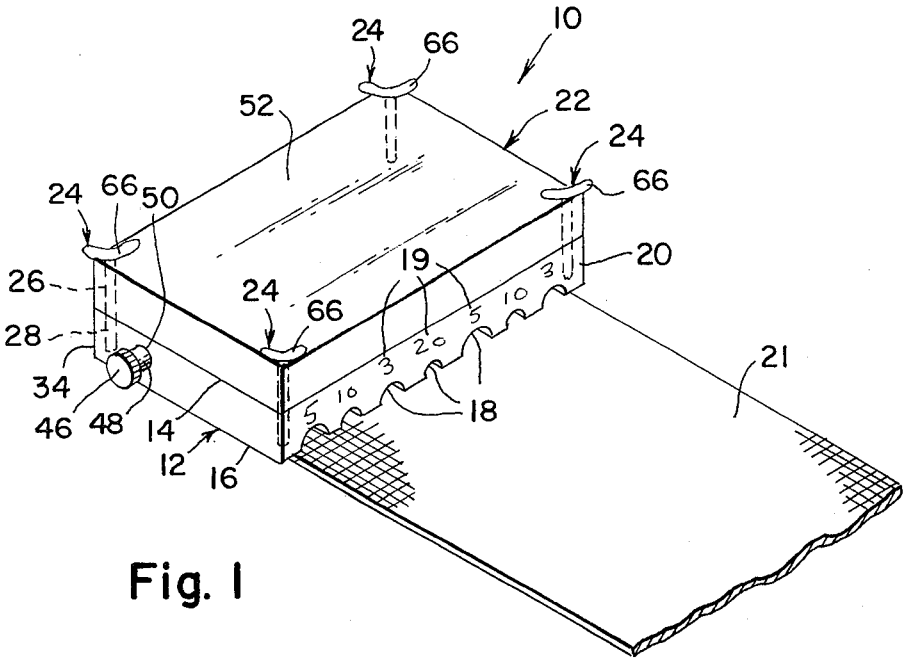
FIG. 1 illustrates a perspective view of the preferred embodiment of the present invention.

Referring now to the drawings, and more particularly to FIG. 1, there is illustrated therein a game apparatus 10 for use with marbles or the like. The game apparatus 10 includes a unitary housing 12 having substantially parallel upper and lower surfaces 14 and 16 not shown. A plurality of apertures 18 are disposed in a first lateral surface 20 of the housing 12. The apertures 18 are adjacent the lower surface 16 and may be intersected thereby as shown forming semi-circular shaped apertures. The apertures 18 vary in size and are marked with suitable indicia 19 in a corresponding relationship wherein as the apertures increase in size they are designated with a smaller numerical value. A substantially rectangular flexible sheet element 21 extends outwardly from the housing and the relationship thereto will be hereinafter described. An upper hollow housing 22 is shown in place affixed to the unitary housing 12 by a plurality of bolt elements 24 adapted to cooperate with aligning passages 26 and 28 disposed in the unitary housing 12 and the upper hollow housing 22 respectively.

Figure 2:
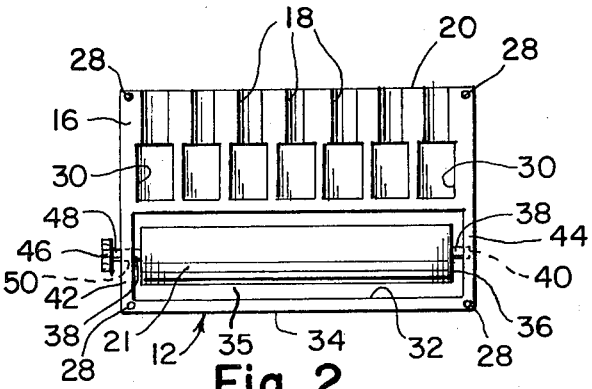
FIG. 2 illustrates a bottom plan view of the unitary housing.

FIG. 2 illustrates a bottom view of the unitary housing 12 and shows the lower surface 16. Each of the plurality of apertures 18 are adapted to permit the passage of a spherically shaped surface such as a marble or the like therethrough and into a corresponding one of the plurality of discrete collecting chambers 30 which is disposed in the housing 12. The housing 12 also includes an elongated chamber 32 disposed therein adjacent to a second lateral surface 34 of the housing 12, opposite and substantially parallel to the first lateral surface 20. The lower surface 16 has an elongated opening 35 disposed therein which extends into the elongated chamber 32.

An elongated roller element 36 is rotatably secured within the elongated chamber 32 by a pair of pin elements 38 affixed on one free end thereof to the elongated roller element 36. The pin elements on the other ends thereof are rotatably secured within and are adapted to journal with holes 40 disposed in opposite walls 42 and 44 of the elongated chamber 32. The flexible sheet element 21 is affixed on a free edge thereof to the roller element 36 and is rolled therearound. When in use the sheet element 21 is passed through the elongated opening 34 and outwardly toward the apertures 18.

The roller 36 may be rotated from the outside of the housing by a knob element 46 which is affixed to one end of the shaft element 48. The opposite end of the shaft element 48 passes through an opening 50 in the housing 12 and is affixed coaxially to a pin element 38.

Figure 3:
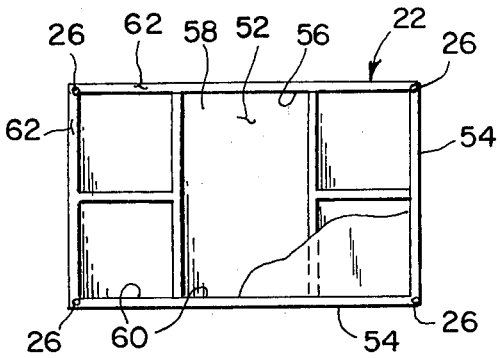
FIG. 3 illustrates a bottom plan view of the upper hollow housing.

FIG. 3 illustrates a bottom view of the upper hollow housing 22 which includes a base portion 52 and a plurality of longitudinal side walls 54 affixed to the free edges of the base portion forming a chamber 56. The chamber 56 has an open side 58 and is divided into a plurality of sub-chambers 60 which are used to store marbles or the like. The free edges 62 of the side walls 54 are dimensioned to contact the upper surface 14 of the unitary housing 12 when placed thereagainst, thereby securing the marbles or the like within the sub-chambers 60.

Figure 4:
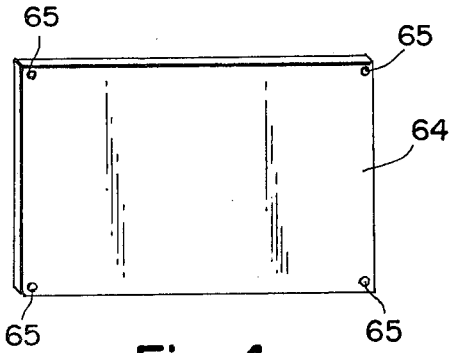
FIG. 4 illustrates a perspective view of the cover element and FIG. 5 illustrates a bolt element.
Figure 5:
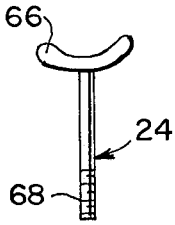

FIG. 4 illustrates a cover element 64 dimensioned to contact and cover the lower surface 16 of the unitary housing 12 when placed thereagainst, thereby enclosing the elongated chamber 32 and securing the contents thereof therein. A plurality of threaded holes 65 are provided in the cover element 64. A bolt element 24 is shown and includes a wing top portion 66 and a threaded portion 68.

When not in use the upper hollow housing 22 and the cover element 64 are placed against the upper and lower surfaces 14 and 16 of the unitary housing 12 as previously described. The bolt elements 24 are passed through the passages 26 and 28 and the threaded portions 68 of the bolt elements 24 are threaded into the threaded holes 65 in the cover element 64 thereby securing the upper housing 22 and the cover element 64 to the unitary housing 12.

When in use the upper housing 22 and the cover element 64 are removed from the unitary housing 12. The flexible sheet element 22 is extended outwardly in front of the apertures 18 providing a primary playing surface. The housing 12 is placed at a desired distance and angle from the players on a supporting surface such as a grass lawn, carpeting, concrete, or the like which provides a secondary playing surface.

Each player is issued a quantity of marbles, preferably 25 in number. The remaining marbles, preferably 200 in number are given to a player designated as the "bank". Each player except the banker rolls his marbles in sequence, five per turn, toward the apertures 18. The marbles are always rolled on the primary playing surface but may also be rolled on the secondary playing surface.

Marbles entering the apertures 18 win a number of marbles from the banker corresponding to the numerical value assigned to the specific aperture 18 entered. If a marble doesn't roll into an aperture 18 it is lost to the banker.

A marble must not stay in an aperture 18 or the corresponding collecting chambers 30 to win. Entry followed by subsequent exit is sufficient. If all of a player's marbles are lost he is out of the game. When the bank no longer possess any marbles the player possessing the most marble assumes the role of the banker and play continues until one player has won all the marbles and is declared the winner. The winner becomes the banker for a new game.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A game apparatus for use with marbles or the like comprising a lower housing having a lowermost surface utilized to support said lower housing on a horizontal supporting surface, said lower housing having a plurality of discrete collecting chambers therein, said lower housing having a plurality of apertures disposed in a first lateral wall thereof, each of said apertures adapted to permit the passage of spherical shaped elements into a corresponding one of said collecting chambers, said lower housing having a discrete elongated roller and sheet housing chamber therein, said discrete elongated roller and sheet chamber being adjacent a second lateral wall spaced from said first lateral wall, said lowermost surface having an elongated opening therein extending into said discrete elongated roller and sheet housing chamber an elongated roller element disposed within said elongated roller and sheet housing chamber, a substantially rectangular flexible sheet element affixed on a free edge thereof to said roller element, said sheet element adapted to pass downwardly through said elongated opening and thence extending outwardly horizontally toward said apertures and thereinfront said sheet element thereby serving as a playing surface, rotatable securing means for rotatably securing said roller element within said elongated roller and sheet housing chamber, rotating means for rotating said elongated roller element and for wrapping said sheet therearound into a storage position within said roller and sheet housing, a portion of said rotating means accessable outside said lower housing, further comprising an additional upper hollow housing having a base portion and a plurality of longitudinal perpendicular side walls affixed to the edges of said base portion forming a chamber having an open side, said chamber divided into a plurality of sub-chambers, the free edges of said side walls adjacent said open side dimensioned to contact the uppermost surface of said lower housing when placed thereagainst, first affixing means for securing said upper housing to said lower housing thereby securing the contents of said sub-chambers therein.

2. The game apparatus as claimed in claim 1, wherein said rotating means comprises a rod element affixed on one free end thereof coaxial to said elongated roller element, a portion of said rod element adjacent the other end thereof passing through and out of an opening disposed in said lower housing and a knob element affixed to said other free end of said rod element, further comprising said first affixing means detachably affixing said upper housing to said uppermost surface of said unitary housing.

3. The game apparatus as claimed in claim 2, wherein said first affixing means comprises a plurality of bolt elements adapted to threadably cooperate with a plurality of passages disposed in said upper housing and said unitary housing, said passage disposed in said upper housing aligned with said passages disposed in said unitary housing.

* * * * *